United States Patent [19]

Zeitvogel

[11] Patent Number: 4,978,939

[45] Date of Patent: Dec. 18, 1990

[54] SETTABLE RESISTOR

[75] Inventor: Heinrich Zeitvogel, Ingolstadt, Fed. Rep. of Germany

[73] Assignee: Telefunken electronic GmbH, Heilbronn, Fed. Rep. of Germany

[21] Appl. No.: 344,977

[22] Filed: Apr. 28, 1989

[30] Foreign Application Priority Data

Jun. 25, 1988 [DE] Fed. Rep. of Germany ..... 3821562

[51] Int. Cl.[5] ..... H01C 10/38

[52] U.S. Cl. ..... 338/176; 338/179; 338/180; 338/194

[58] Field of Search ..... 338/176, 180, 165, 179, 338/190, 194, 143, 157, 158

[56] References Cited

U.S. PATENT DOCUMENTS

| | | | |
|---|---|---|---|
| 1,938,396 | 12/1933 | Megow | 338/165 X |
| 3,156,888 | 11/1964 | Blanco | 338/143 X |
| 3,535,670 | 10/1970 | Gerwitz | 338/143 |
| 3,599,141 | 8/1971 | Hildreth | 338/164 X |
| 3,648,217 | 3/1972 | DeLong et al. | 338/143 |
| 4,097,704 | 6/1978 | Piber . | |

FOREIGN PATENT DOCUMENTS

| | | |
|---|---|---|
| 652202 | 10/1937 | Fed. Rep. of Germany . |
| 2119686 | 12/1971 | Fed. Rep. of Germany . |
| 8802883 | 6/1988 | Fed. Rep. of Germany . |

*Primary Examiner*—Bruce A. Reynolds
*Assistant Examiner*—Marvin M. Lateef
*Attorney, Agent, or Firm*—Spencer & Frank

[57] ABSTRACT

A settable resistor has a resistance path array (4) to which is allocated a contact piece (9) which is guidable in the longitudinal direction (13) over the resistance path array and has an adjusting device for the position of the contact piece. In order not to restrict the free displacement travel of the contact piece with a simple construction independent of the setting of the adjusting device, so that a high resolution is achieved particularly for application in the hand switch of a power tool with speed control regardless of a set maximum value, the contact piece (9) is additionally adjustable transverse to the longitudinal direction (13of the resistance path array (4) by means of the adjusting device (11).

21 Claims, 2 Drawing Sheets

SETTABLE RESISTOR

BACKGROUND OF THE INVENTION

The invention relates to a settable resistor having a resistance path array to which is allocated a contact piece, the two being adjustable relative to one another in the longitudinal direction of the resistance path array, and having an adjusting device, particularly for use hand switches of power tools. In a known settable resistor in a hand switch for a power tool with integral speed control (U.S. Pat. No. 4,097,704), a simple resistance path is provided on a substrate supporting further electrical components, and runs in the longitudinal direction parallel to a slide to which is attached a contact piece fitted in sliding fashion on the resistance path. The slide is also connected to a switch in the circuit of the electrical control array and mechanically connected to a trigger to be actuated manually. In the trigger is a setting wheel having a threaded rod and being associated with a stop slide which is moved in the axial direction of the slide by turning the setting wheel and thereby limiting the displacement travel of the slide and thus of the contact piece in the manner of an adjusting device. The contact piece slides at the same time on a conducting path running parallel to the resistance path. With this construction, the resistance value picked up at the resistance path and affecting, for example, the speed of a drive motor controlled by the control circuit, is solely dependent on the displacement travel of the slide and thereby on the position of the contact piece in the longitudinal direction of the resistance path. The adjustment travel of the slide depends here on the setting of the adjusting device and is limited to a relatively small section of the overall displacement travel when only correspondingly low speeds are to be achieved with the slide pressed all the way in. Intermediate values of the resistance or speed are therefore only settable within the correspondingly shortened overall displacement travel.

SUMMARY OF THE INVENTION

The object of the invention is to provide a settable resistor having a resistance path array and a contact piece in mutual contact, each being independently adjustable relative to one another in the longitudinal direction of the resistance path array and which can be set over the entire available displacement travel of the contact piece regardless of a preset resistance.

This object is attained in accordance with the invention by the contact piece and/or the resistance path array being additionally independently adjustable transverse to the longitudinal direction without motion in the longitudinal direction of the resistance path array using the adjusting device. In a design for a settable resistor in accordance with the invention, the entire displacement travel intended for the contact piece is retained in all settings of the adjusting device over the entire active length of the resistance path array, since the contact piece is additionally adjusted transverse to the longitudinal direction of the resistance path array and the effective resistance is changed over the entire adjustment travel. The result is a high resolution regardless of the preset maximum value. In the simplest case, the resistance path only has to be contacted in the area of one end on a longitudinal edge, so that in the event of a transverse displacement of the contact piece at least the effective basic resistance is changed, to which the normal rise in resistance is added through the adjustment travel when the remaining resistor surface is homogeneous. However, the resistance path array preferably has zones of differing electrical conductivity transverse to its longitudinal direction, so that differing resistance characteristics result over the displacement travel in the longitudinal direction depending on the resistance path selected. The various resistance paths can be separated from one another by insulating cavities or follow on from one another without gaps in the transverse direction. If the contact piece, transverse to the longitudinal direction of the resistance paths, has a width which is not greater than the width of one resistance path, then the resistance paths are constructed of materials with differing conductivity. If, on the other hand, the contact piece is designed to be sufficiently wide that it reaches over all resistance paths of the resistance path array transverse to the longitudinal direction, the resistance paths or zones can each have the same resistance characteristics, since the resistance paths are contacted parallel in the transverse direction depending on the displacement travel, and the overall resistance changes thereby. With resistance paths separated from one another in the longitudinal direction, it is also possible here to ensure contact of the paths separately at one end in the event that various control parameters are to be affected via individual paths, such as speed, torque and so on. The resistance paths array can be deposited both on a plane and on a cylindrical substrate, with the resistance paths in the cylindrical array being able to extend parallel to one another in the axis direction if the contact piece is movably arranged for transverse adjustment in the circumferential direction. If the resistance paths are, on the other hand, arranged to run in the circumferential direction, the contact piece only needs to be mounted movably in the axial direction of the cylinder. The contact piece is preferably movable over its transverse adjustment travel to engagement positions that can be overrun, so that contact is assured of certain allocated resistance paths particularly in the case of resistance paths insulated from one another in the longitudinal direction. In addition, no change in the set value occurs in the event of axial locking of the slide or contact piece.

BRIEF DESCRIPTION OF THE DRAWINGS

The invention will now be described in greater detail, with reference to sketches showing the embodiment principles.

DESCRIPTION OF THE PREFERRED EMBODIMENTS

Figure 2:
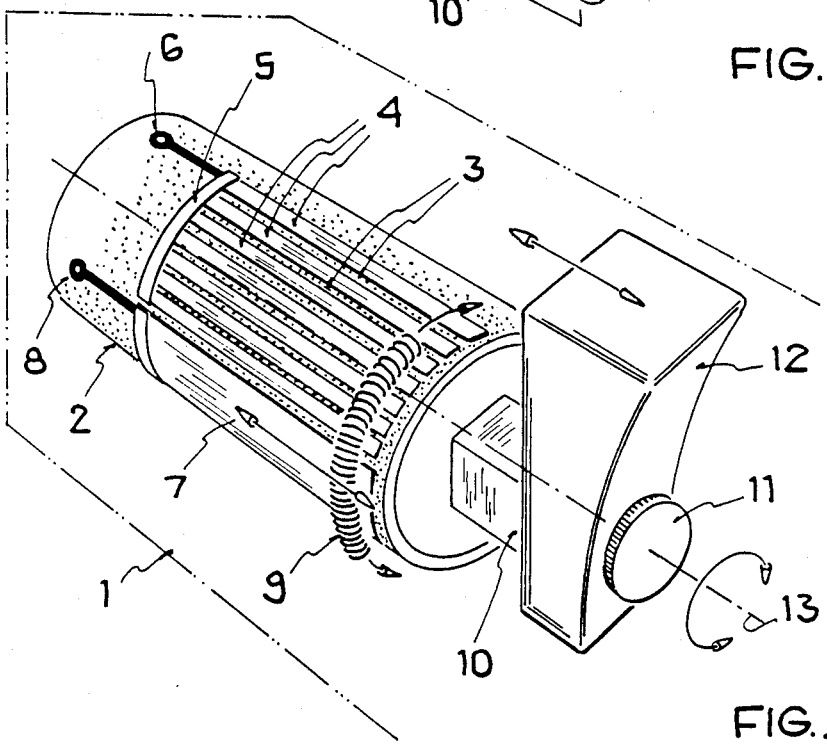
FIG. 2 shows a settable resistor on a cylindrical substrate.

In a switch housing 1 of a hand switch for a power tool with integral electronic speed control and electrical switching contacts (not shown) is a substrate 2 with resistance paths preferably applied using thick-film technology, parallel to one another, and if necessary separated from one another in the longitudinal direction by an insulating cavity 3. The resistance paths 4 are electrically connected with low resistance to one another at one of the longitudinal ends via a conducting path 5 or via a resistor strip forming at the same time an external connection 6. A slide contact path 7 extends parallel to resistance paths 4 of the resistance path array and can, like conducting path 5, comprise a conductive silver imprint or a resistive material. Slide contact path 2 is provided with a further external connection 8. For the option of connecting slide contact path 7 with one or more of the resistance paths 4, a contact piece 9 designed as a sliding contact is provided that rests on slide contact path 7 on one side and can be brought into contact with resistance paths 4 on the other side when required. Contact piece 9 is here assigned to a slide 10 which is movable parallel to the longitudinal direction of resistance paths 4 and is connected to contact piece 9 in such a way that contact piece 9 is not adjustable axially to it, but transverse to the longitudinal direction of resistance paths 4 or the sliding direction. For transverse adjustment of contact piece 9, a setting element 11 is used as the adjusting device and is held adjustably in trigger 12 rigidly connected to the slide. Trigger 12 is for manual actuation of the slide 10, which operates not only contact piece 9 but also the electrical contacts already mentioned. Setting element 11 can be designed as a sliding unit which is movably supported transverse to the longitudinal direction of resistance path 4 and can be coupled directly to contact piece 9. If, however, setting element 11 is supported rotatably in trigger 12 as a setting wheel, a gear-type connection, now shown, is required between setting wheel 11 and contact piece 9 if the substrate is plane. If substrate 2 and slide 10 are designed cylindrical, as shown in FIG. 2, contact piece 9 can be connected non-rotatably to setting wheel 11, so that slide 10 can be adjusted both radially and axially. If the contact piece in the area of slide contact path 7 and in the area of resistance paths 4 has only one dot- or strip-type contact area in each case, slide contact path 7 is adapted in width to the transverse adjustment travel of contact piece 9. Contact piece 9 is here designed to be sufficiently wide in the transverse direction that it is still in contact with slide contact path 7 while also in contact with the most remote resistance path 4. It is however also possible to provide slide contact path 7 in the axial extension of resistance paths 4 if contact piece 9 has a length reaching from this slide contact path to the opposite end of the respective resistance path 4. It is of course also possible to combine resistance paths 4 having a comb-like arrangement with slide contact paths electrically insulated from them but interlocking in comb fashion, contact piece 9 then connecting at least one of the resistance paths 4 to at least one of the slide contact paths in each case.

It is also possible to design contact piece 9 as a coiled spring extending transverse to the longitudinal direction of resistance paths 4 and being supported over its entire axial length on substrate 2 or the respective slide contact path 7 and on at least one of the resistance paths 4 depending on the setting of setting element 11. Coiled spring 9 is suitable in particular for cylindrical substrate 2, since it is then automatically in contact with the circumference of the substrate 2 when supported adequately, without special adjustment measures, as shown in FIG. 2.

In addition, resistance path array 4 can also run in its longitudinal direction along the generating lines of a cylinder jacket. The contact piece is then concentrically rotatable in relation to the cylinder jacket and in addition movably supported in its axial direction. By turning the contact piece it is thus possible to contact one or more of the paths of the resistance path array in the longitudinal direction, whereas by axial displacement of the contact piece the number of resistance paths to be contacted is changed depending on the slide-in depth or on the design of the contact piece (point or line shape at least over the length of the transverse displacement travel).

Figure 3:
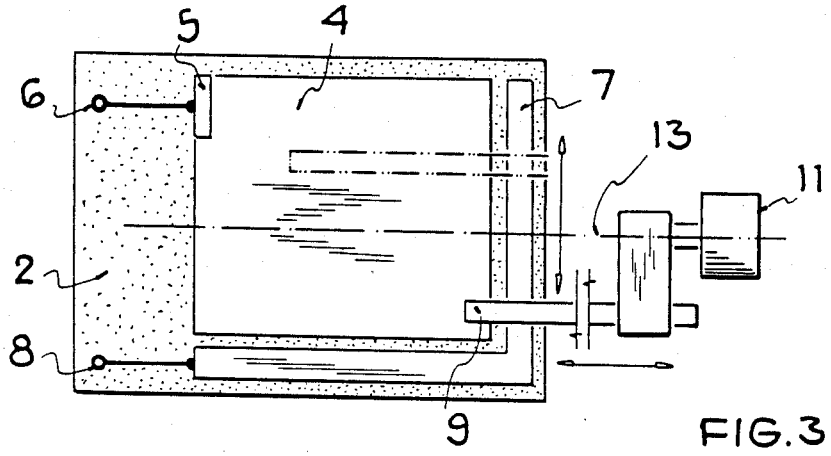
FIG. 3 shows a settable resistor with a homogeneous resistance path array.

In the simplest embodiment, resistance path array 4 can comprise a homogeneous resistance layer as shown in FIG. 3, which extends not only in the longitudinal direction indicated by the dash-dotted line 13, but also transversely thereto over a considerable distance. The contact area of resistance path array 4 with a low-resistance conducting path 5 is limited solely to an immediate corner area of the resistor surface and does not extend over the entire longitudinal side edge. If contact piece 9 is here in the immediate vicinity of the short conducting path 5, the resistance picked up between external connections 6 and 8 has its lowest value. This value increases in the event of a parallel displacement in relation to longitudinal direction 13. If contact piece 9 is moved by transverse displacement to a position remote from conducting path 5, as shown in FIG. 3, then the resistance value has an initial value corresponding to the distance between conducting path 5 and contact piece 9. This initial value is increased by adjustment of contact piece 9 parallel to longitudinal direction 13. Even if resistance path array 4 is designed homogeneous, a different end value is achieved in this case depending on the transverse adjustment of contact piece 9 when the latter is adjusted in the longitudinal direction 13.

Figure 1:
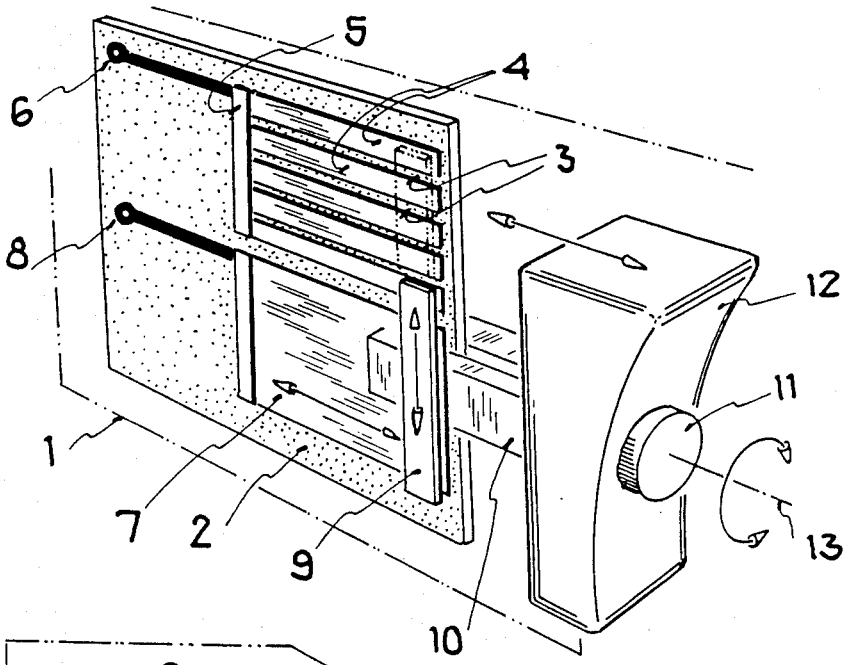
FIG. 1 shows a settable resistor on a plane substrate in conjunction with a hand switch.
Figure 4:
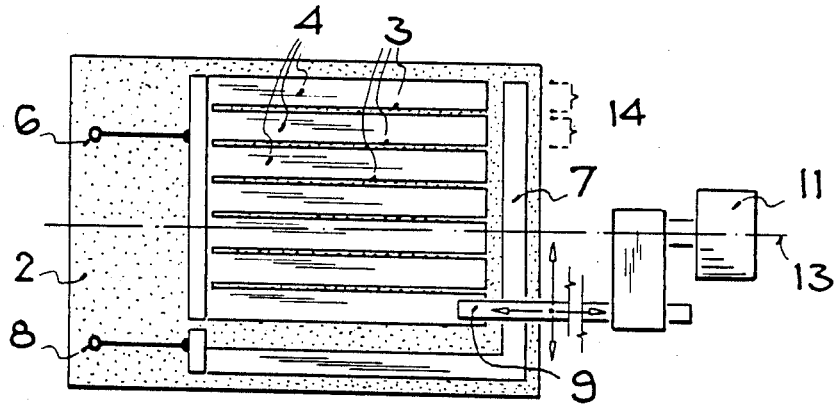
FIG. 4 shows a settable resistor and adjacent resistance paths of differing electrical conductivity.

Preferably, however, the resistance path array in accordance with FIGS. 1, 2 and 4 is provided transverse to its longitudinal direction 13 with zones 14 of differing electrical conductivity. Here, the insulating cavity 3 is provided as a zone of low conductivity between individually resistance paths 4 extending in the longitudinal direction, as shown in FIGS. 1 and 2. The zone of high conductivity with resistant coating therefore alternate with low-conductivity insulating zones. The individual resistance paths 4 can have differing conductivities here, i.e. consist of materials having different specific resistances or change in conductivity on a logarithmic basis in the longitudinal direction. The low-conductivity zones 3 can be generated by laser etching thereby achieving as fine a division of the resistance path array as required.

It is however also possible to construct all the zones 14 of electrically resistant material and to join them without gaps in the transverse direction (FIG. 4). Here, conducting path 5 can extend in the transverse direction over all zones 14 analogously to the design in accordance with FIGS. 1 and 2, or be arranged limited to a corner area only in accordance with FIG. 3. It is also possible to design the contact piece as a dot or line, so that either just one of the zones is contacted with an adjustment of the contact piece 9 in the longitudinal direction 13 or several zones are contacted parallel to one another. In addition, the slide contact path or the resistor strip 7 can generally be provided, unlike in FIG. 1, at the end of resistance path array 4 which is adjacent to the initial position of the contact piece 9, i.e. before its manual adjustment.

It is, of course, also possible to design a resistor of this type using foil technology, with a conductively treated foil being arranged preferably at a distance above the conducting path array and acting as a contact piece which upon pressure of a finger-type slider presses the foil with the contact piece onto the zone of resistance path 4 underneath it only in the area of the slider. The foil here insulates the contact piece against external access. The slider can, like the contact piece in the embodiments, be arranged to be adjustable mechanically in the longitudinal direction and by the adjusting device in the transverse direction.

Figure 5:
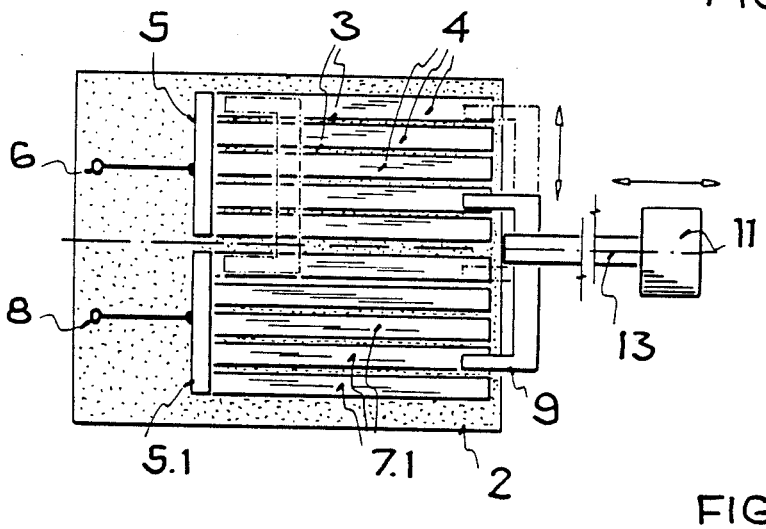
FIG. 5 shows a settable resistor with divided slide contact path.

In accordance with FIG. 5, slide contact path 7 is constructed, unlike the version in FIG. 1, from individual slide contact paths 7.1 running parallel to the resistance paths 4, so that each resistance path 4 is associated with an individual slide contact path 7.1. Contact piece 9 here contacts one individual slide contact path 7.1 and its associated resistance path 4 and is releasably engaged by a multi-stage catch to prevent transverse adjustment in relation to the longitudinal direction 13.

The cylindrical embodiment in accordance with FIG. 2 can be achieved in simple form by the cylindrically formed substrate 2 being designed as hollow, as a modification to the embodiment shown, and supporting elements 3 to 8 on the internal jacket surface.

Slide 10, which may be cylindrical, can then be inserted into the cavity and have the contact piece 9 on its outer surface. Slide 10 can then be adjusted in simple fashion axially using trigger 12 and radially using setting element 11, in order to contact the resistance paths 4 in the longitudinal direction and change the resistance value in the circumferential direction as required.

What is claimed is:

1. A settable resistor particularly for hand switches of power tools, comprising a resistance path array, a contact piece, the resistance path array and the contact piece being in contact and independently adjustable relative to one another in a longitudinal direction without motion in a transverse direction of said resistance path array, and an adjusting device which causes said contact piece and/or said resistance path array to be additionally independently adjustable transverse to the longitudinal direction of said resistance path array without motion in the longitudinal direction, and the contact piece and the resistance path array being simultaneously independently adjustable in both the longitudinal and transverse directions.

2. A resistor according to claim 1, wherein the resistance path array has zones of differing electrical conductivity transverse to its longitudinal direction.

3. A settable resistor particularly for hand switches of power tools, comprising a resistance path array having alternating zones of low and high electrical conductivity transverse to its longitudinal direction; a contact piece, the resistance path array and the contact piece being in contact and independently adjustable relative to one another in the longitudinal direction without motion in a transverse direction of said resistance path array; and an adjusting device which causes said contact piece and/or said resistance path array to be additionally independently adjustable transverse to the longitudinal direction of said resistance path array without motion in the longitudinal direction, and the contact piece and the resistance path array being simultaneously independently adjustable in both the longitudinal and transverse directions.

4. A resistor according to claim 3, wherein said zones of higher electrical conductivity have differing electrical conductivities.

5. A resistor according to claim 2, wherein the zones comprise electrically resistive material and follow on from one another without gaps in the transverse direction.

6. A resistor according to claim 1, wherein contact piece has a width transverse to the longitudinal direction of the resistance path array corresponding at least approximately to the width of the resistance path array.

7. A resistor according to claim 1, wherein a contact path for contact piece runs parallel to the longitudinal direction.

8. A resistor according to claim 7, wherein the width of contact path is adapted to the displacement travel of contact piece.

9. A resistor according to claim 1, wherein resistance path array is provided at one end over its width with a low-resistance conducting path.

10. A settable resistor particularly for hand switches of power tools, comprising a resistance path array; a contact piece, the resistance path array and the contact piece being in contact and independently adjustable relative to one another in a longitudinal direction without motion in a transverse direction of said resistance path array; the contact piece being fixed on a slide, the slide being adjustable in a straight line in the longitudinal direction of the resistance path array and, adjustably supported transverse thereto, and an adjusting device coupled to said contact piece, said contact piece to be additionally independently adjustable transverse to the longitudinal direction of said resistance path array without motion in the longitudinal direction, and the contact piece and the resistance path array being simultaneously independently adjustable in both the longitudinal and transverse directions.

11. A resistor according to claim 1, wherein adjusting device has a rotary knob mounted rotatably on a slide and meshed by a gear with contact piece.

12. A resistor according to claim 10, wherein resistance path array is provided on a plane substrate support.

13. A resistor according to claim 10, wherein resistance path array and contact path are provided on a cylindrical substrate support, and wherein the longitudinal direction of paths is parallel to the axis of the cylinder.

14. A resistor according to claim 1, wherein the longitudinal direction of resistance path array runs along the generating lines of a cylinder jacket, and wherein the contact piece is mounted concentrically rotatable in relation to said cylinder jacket and in addition movable in its axis direction.

15. A resistor according to claim 1, wherein contact piece is designed as a coiled spring whose axis direction is transverse to the longitudinal direction of resistance path array.

16. A resistor according to claim 1, wherein contact piece is connected to a slide connected to a manually actuatable trigger coupled with a switch, and wherein said trigger is additionally allocated a setting element with which said contact piece is settable, transverse to the adjustment direction of said slide.

17. A resistor according to claim 1, wherein the adjusting device has engagement positions for contact piece whose spacing corresponds to the spacing of the allocated zones transverse to the longitudinal direction of the resistance paths.

18. A resistor according to claim 1, wherein resistance path array has a non-linear resistance curve in the longitudinal direction.

19. A resistor according to claim 1, wherein contact piece is arranged on a cylindrical slide mounted both rotatably about its longitudinal axis and axially movable, and wherein substrate with resistance path array is designed and arranged as a concentric cylinder jacket.

20. A resistor according to claim 1, wherein resistance path array is provided at one end over its width with a resistor strip.

21. A resistor according to claim 1, wherein a slide contact path or a resistor strip is provided adjacent to and/or remote from that end of resistance path array adjacent to the initial position of contact piece.

* * * * *